US011101533B2

(12) United States Patent
Huang et al.

(10) Patent No.: US 11,101,533 B2
(45) Date of Patent: Aug. 24, 2021

(54) RADIO FREQUENCY DEVICE

(71) Applicant: WIN Semiconductors Corp., Tao Yuan (TW)

(72) Inventors: Chih-Wen Huang, Taoyuan (TW); Jui-Chieh Chiu, Taoyuan (TW)

(73) Assignee: WIN Semiconductors Corp., Tao Yuan (TW)

( * ) Notice: Subject to any disclaimer, the term of this patent is extended or adjusted under 35 U.S.C. 154(b) by 63 days.

(21) Appl. No.: 15/292,127

(22) Filed: Oct. 13, 2016

(65) Prior Publication Data

US 2018/0108965 A1 Apr. 19, 2018

(51) Int. Cl.
*H01P 3/00* (2006.01)

(52) U.S. Cl.
CPC ..... *H01P 3/003* (2013.01); *H01P 3/006* (2013.01)

(58) Field of Classification Search
CPC ..... H01P 3/003
USPC ..... 333/239
See application file for complete search history.

(56) References Cited

U.S. PATENT DOCUMENTS

2008/0100394 A1* 5/2008 Margomenos ..... H01P 1/047 333/32
2009/0029570 A1* 1/2009 Ikeuchi ..... H01P 1/047 439/67
2017/0093007 A1* 3/2017 Elsherbini ..... H01P 3/08

FOREIGN PATENT DOCUMENTS

CN 101369573 A 2/2009
CN 102074774 A 5/2011

OTHER PUBLICATIONS

Rainee N. Simons, "Coplanar Waveguide Circuits, Components, and Systems", Copyright © 2001 John Wiley & Sons, Inc., ISBNs:0-471-16121-7(Hardback); 0-471-22475-8 (Electronic), pp. 288-291, 294-296, Wiley-Interscience, A John Wiley & Sons, Inc., Publication.

* cited by examiner

*Primary Examiner* — Samuel S Outten
(74) *Attorney, Agent, or Firm* — Winston Hsu

(57) ABSTRACT

A radio frequency (RF) device includes a chip comprising a plurality of vias and at least a hot via; a signal lead and a ground lead disposed under a back side of the chip; and a signal metal sheet, a first ground metal sheet and a second ground metal sheet disposed on a top side of the chip. The signal metal sheet crosses over the first gap formed between the signal lead and the ground lead. The first ground metal sheet and the second ground metal sheet are coupled to the ground lead through the plurality of vias. The first ground metal sheet and the second ground metal sheet substantially surround the signal metal sheet.

9 Claims, 10 Drawing Sheets

RADIO FREQUENCY DEVICE

BACKGROUND OF THE INVENTION

1. Field of the Invention

The present invention relates to a radio frequency (RF) device, and more particularly, to an RF device which is easy to be assembled and capable of achieving good high frequency performance.

2. Description of the Prior Art

As technology evolves, wireless communication is an important part of human life. Various electronic devices, such as smart phones, smart wearable devices, tablets, etc., utilize wireless radio frequency (RF) devices to transmit and receive wireless RF signals.

A recently developed RF device comprises a ground lead and a signal lead disposed under a back side of a chip of the RF device. A gap is formed between the ground lead and the signal lead. The gap between the ground lead and the signal lead should be sufficient large, to be easy to be assembled with an external circuit and prevent the short circuit problem. However, the large gap between the signal lead and the ground lead sacrifices high frequency performance (i.e., RF performance), which means that the RF performance is worse as the gap between the signal lead and the ground lead is larger.

Therefore, how to provide an RF device which is easy to be assembled and achieves good RF performance is a significant objective in the field.

SUMMARY OF THE INVENTION

It is therefore a primary objective of the present invention to provide an RF device which is easy to be assembled and achieves good RF performance, to improve over disadvantages of the prior art.

An embodiment of the present invention discloses a radio frequency (RF) device. The RF device comprises a chip, comprising a plurality of vias and at least a hot via; a signal lead, disposed under a back side of the chip; a ground lead, disposed under the back side of the chip, and substantially surrounding the signal lead, wherein a first gap is formed between the signal lead and the ground lead; a signal metal sheet, disposed on a top side of the chip, and coupled to the signal lead through the at least a hot via, wherein the signal metal sheet crosses over the second gap formed between the signal lead and the ground lead; a first ground metal sheet, disposed on the top side of the chip; and a second ground metal sheet, disposed on the top side of the chip; wherein the first ground metal sheet and the second ground metal sheet are coupled to the ground lead through the plurality of vias, and the first ground metal sheet and the second ground metal sheet substantially surround the signal metal sheet These and other objectives of the present invention will no doubt become obvious to those of ordinary skill in the art after reading the following detailed description of the preferred embodiment that is illustrated in the various figures and drawings.

DETAILED DESCRIPTION

Figure 1:
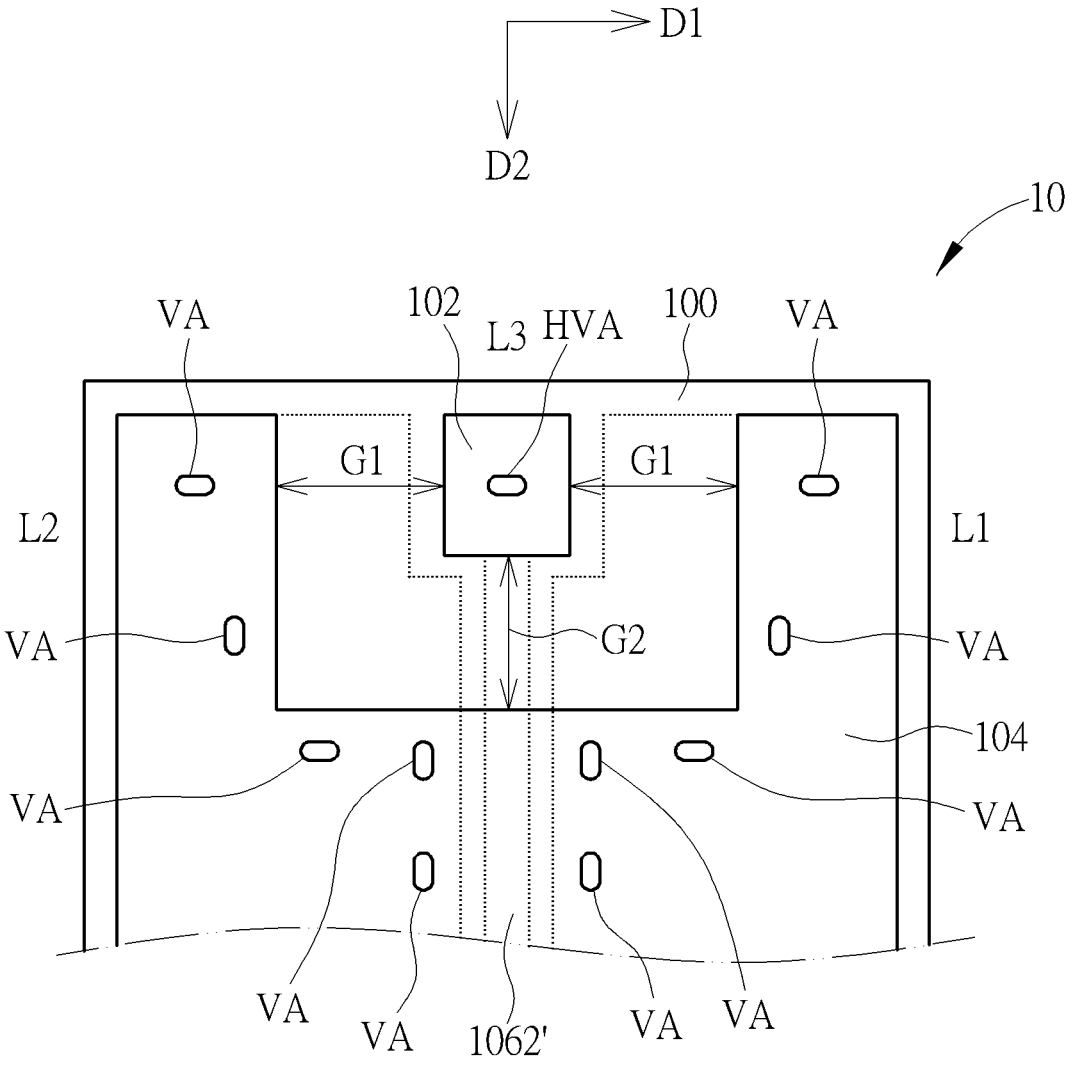
FIG. 1 illustrates a bottom view of a radio frequency (RF) device according to an embodiment of the present invention.
Figure 2:
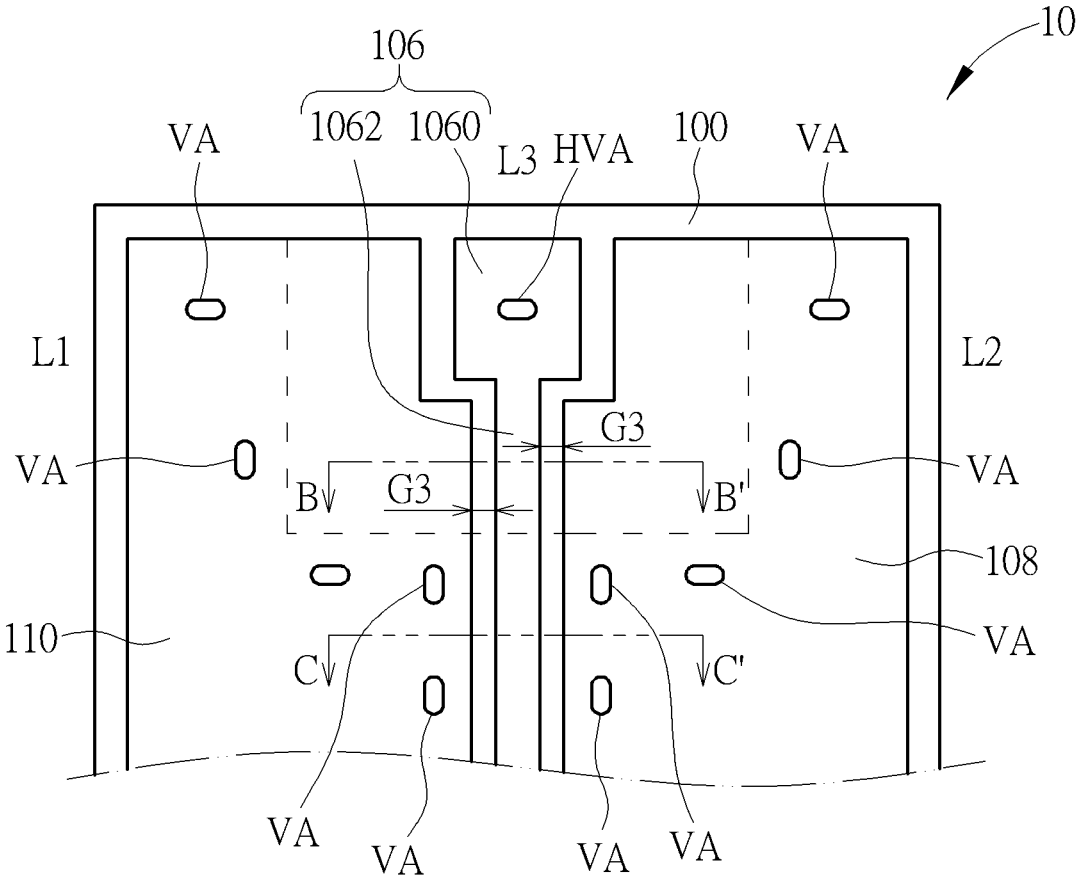
FIG. 2 illustrates a top view of the RF device of FIG. 1.
Figure 3:
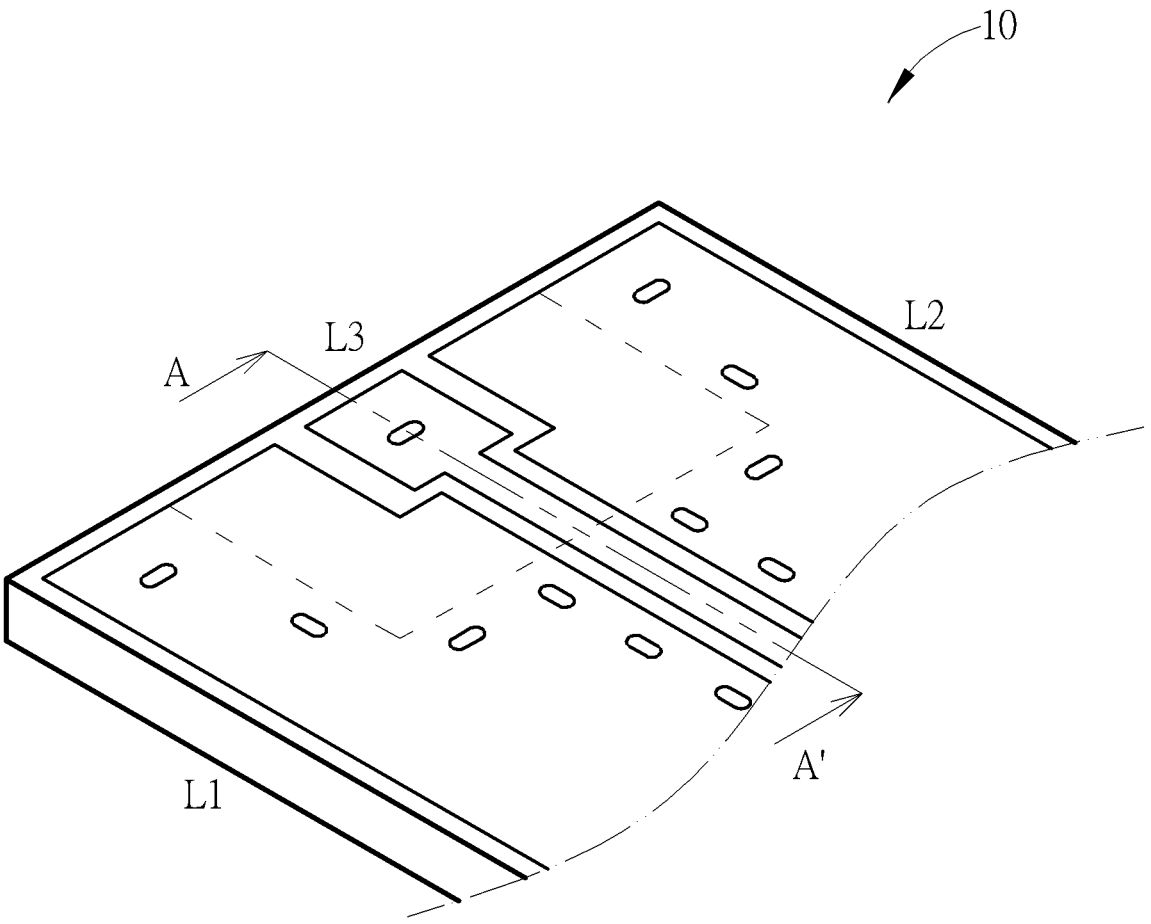
FIG. 3 illustrates a perspective view emphasizing a top side of the RF device of FIG. 1.
Figure 4:
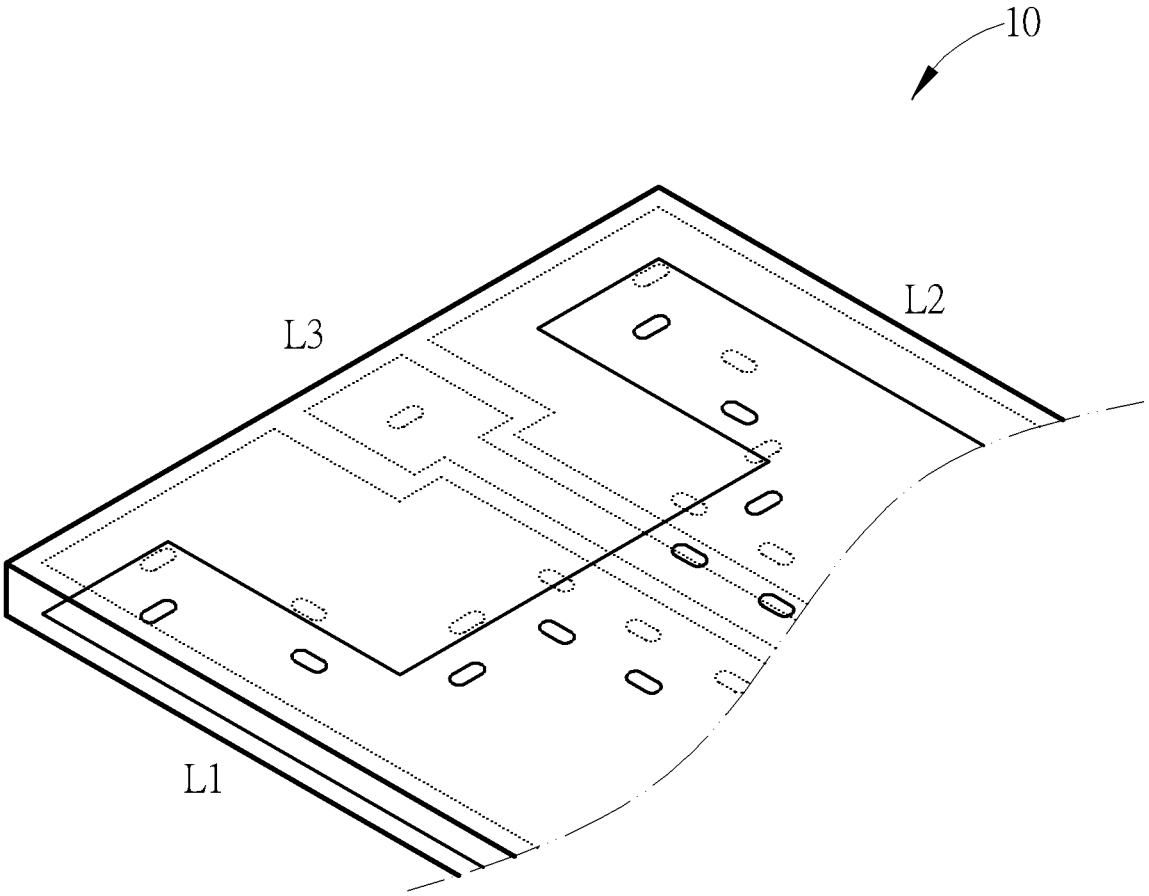
FIG. 4 illustrates a perspective view emphasizing a back side of the RF device of FIG. 1.
Figure 5:
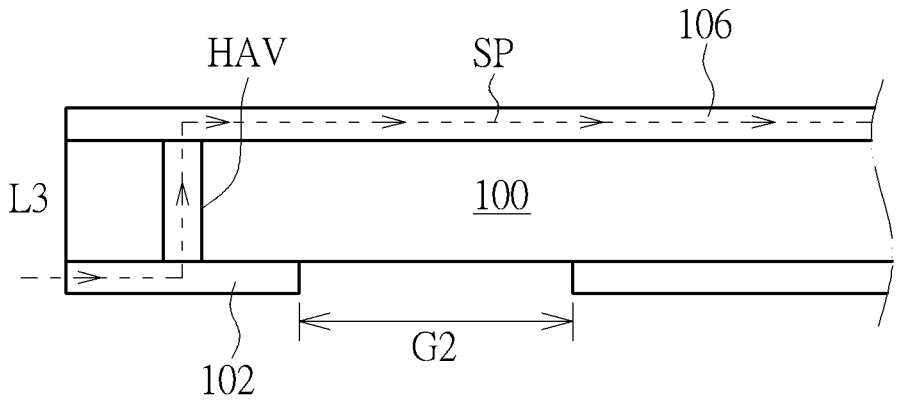
FIG. 5 is a schematic diagram of a sectional side view of the RF device of FIG. 1.

Please refer to FIGS. 1-5. FIGS. 1 and 2 are schematic diagrams of a bottom view and a top view of a radio frequency (RF) device 10 according to an embodiment of the present invention. FIGS. 3 and 4 are schematic diagrams of a perspective view emphasizing a top side and a back side of the RF device 10. FIG. 5 is a schematic diagram of a sectional side view along an A-A' line in FIG. 3. For illustration purpose, a first edge L1, a second edge L2 and a third edge L3 of the RF device 10 are annotated in FIGS. 1-5. The RF device 10 may be a monolithic microwave integrated circuit (MMIC), which comprises a chip 100, a signal lead 102, a ground lead 104, a signal metal sheet 106, a ground metal sheet 108 and a ground metal sheet 110. Dotted lines in FIG. 1 represent boundaries/edges of projection results of the signal metal sheet 106, the ground metal sheet 108 and the ground metal sheet 110 onto the back side of the RF device 10. Dashed lines (close to the third edge L3) in FIG. 2 and FIG. 3 represent boundaries/edges of the signal lead 102 and the ground lead 104 onto the top side of the RF device 10. In FIG. 4, dotted lines represent boundaries/edges of the signal metal sheet 106, the ground metal sheet 108 and the ground metal sheet 110 onto the back side of the RF device 10. The chip 100 comprises a plurality of vias VA and a hot via HVA, where the vias VA and the hot via HVA may be a through-silicon via (TSV). Notably, the signal lead 102, the signal metal sheet 106, the ground metal sheet 108, the ground metal sheet 110, the ground lead 104, the hot via HVA and the vias VA form a transition structure.

The signal lead 102 and the ground lead 104 are disposed under a back side of the chip 100. The signal lead 102 is configured to receive/transmit an RF signal from/to an external circuit. The ground lead 104 is configured to provide grounding for the chip 100. The ground lead 104 surrounds the signal lead 102, such that the signal lead 102 and the ground lead 104 form a ground-signal-ground (GSG) structure on the backside of the chip 100. Notably, a gap G1 and a gap G2 are formed between the signal lead 102 and the ground lead 104. Specifically, the gap G1 is referred to the gap between the signal lead 102 and the ground lead 104 along with a first direction D1 (shown in FIG. 1), and the gap G2 is referred to the gap between the signal lead 102 and the ground lead 104 along with a second direction D2 (shown in FIG. 1), wherein the first direction D1 is parallel to the third edge L3 of the RF device 10, and the second direction D2 is parallel to the first edge L1 or the second edge L2. To facilitate assembly, the gap G1 and the gap G2 should be sufficiently large/wide, e.g., larger/wider than 50 micrometer (μm), to present short circuit problem thereof. In an embodiment, the gap G1 and the gap G2 may be 300 μm.

Furthermore, the signal metal sheet 106, the ground metal sheet 108 and the ground metal sheet 110 are disposed on a top side of the chip 100. The signal metal sheet 106, crossing over the gap G2 within the back side of the RF device 10, is connected to the signal lead 102 through the hot via HVA, and configured to deliver the RF signal. The ground metal sheet 108 and the ground metal sheet 110 are connected to the ground lead 104 through the vias VA, configured to maintain grounding for the RF device 10.

Notably, the signal metal sheet 106 on the top side of the RF device 10 crosses over the gap G2 (formed between the signal lead 102 and the ground lead 104 along with the second direction D2). Specifically, the signal metal sheet 106 may be divided into metal segments 1060 and 1062, as shown in FIG. 2. The metal segment 1060, formed as rectangles (or squares), is disposed by the third edge L3. A projection result of the metal segment 1060 onto the back side of the RF device is overlapped with the signal lead 102. The metal segment 1062, formed as a rectangle, connects the metal segment 1060 and crosses over the gap G2 within the back side of the RF device. A projection result 1062' of the metal segment 1062 onto the back side of the RF device is across/through the gap G2 and the ground lead 104. That is, the signal metal sheet 106 (on the top side of the RF device 10) crosses over the gap G2 (formed between the signal lead 102 and the ground lead 104 on the backside of the RF device 10 along with the second direction D2). Hence, after the RF signal is received by the signal lead 102, the RF signal would be delivered to the top side of the RF device 10 through the hot via HVA (i.e., to the metal segment 1060), and the RF signal would be delivered through the metal segment 1062 to an internal circuit of the RF device 10. In addition, the ground metal sheet 108 and the ground metal sheet 110 are disposed beside the signal metal sheet 106 (i.e., beside the metal segment 1060 and 1062), which is to form a coplanar waveguide (CPW) structure and enhance an RF performance. Through the metal segment 1062/CPW structure, the RF signal would be delivered to a specified point on the top side of the RF device 10. Notably, a projection result of the specified point onto the back side of the RF device 10 lies within the ground lead 104.

Figure 7:
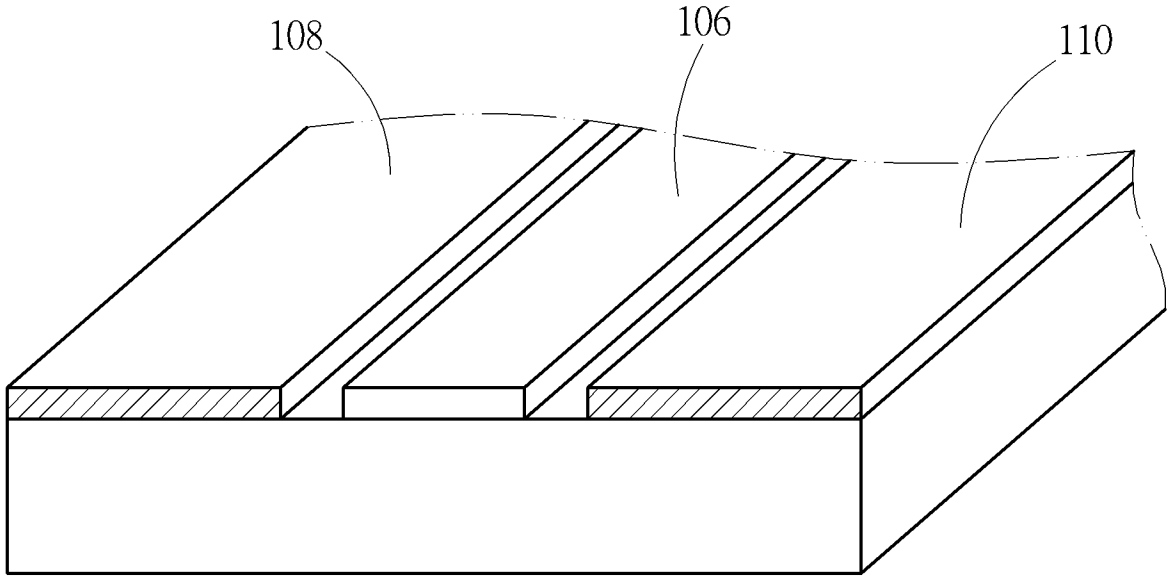
FIG. 7 is a schematic diagram of a sectional side view of the RF device of FIG. 1.
Figure 8:
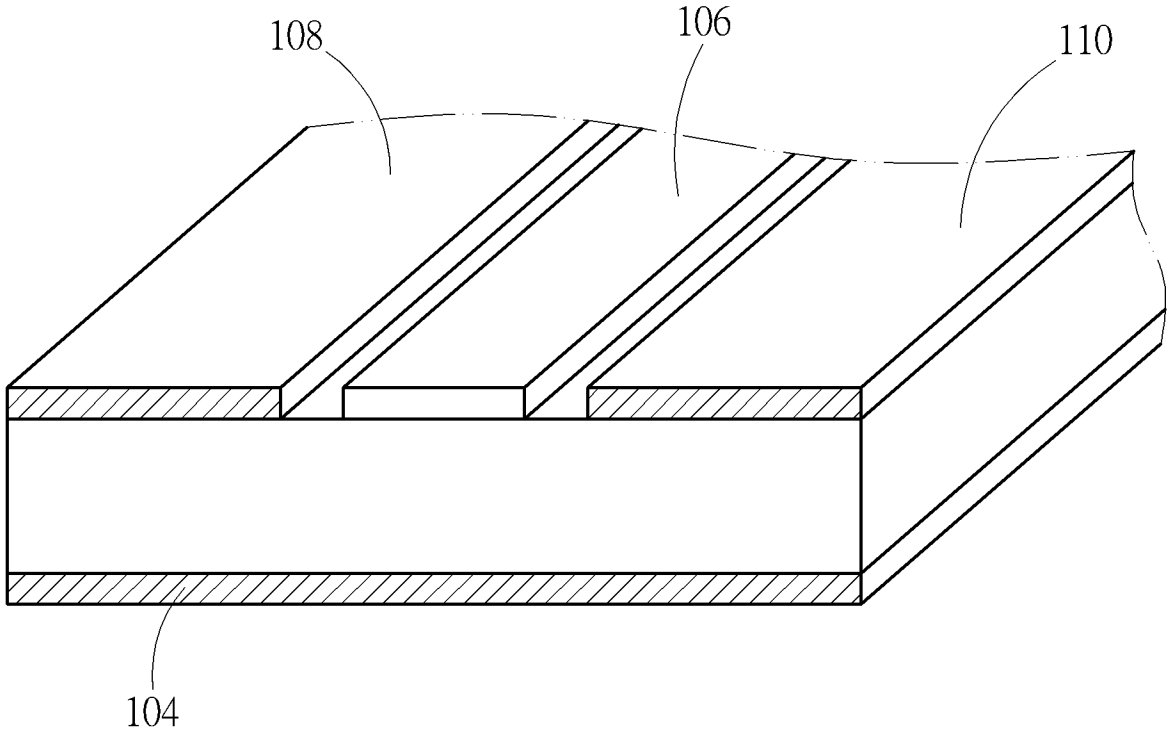
FIG. 8 is a schematic diagram of another sectional side view of the RF device of FIG. 1.

In addition, the ground metal sheet 108 and the ground metal sheet 110 substantially surround the signal metal sheet 106. Specifically, the ground metal sheet 108 and the ground metal sheet 110 are disposed beside the signal metal sheet 106. A gap G3 is formed between the signal metal sheet 106 and the ground metal sheet 108/110. Referring to FIG. 7 and FIG. 8, which are schematic diagrams of a sectional side view of the RF device 10 along a B-B' line and a C-C' line in FIG. 2. As shown in FIG. 7, the signal metal sheet 106, the ground metal sheet 108 and the ground metal sheet 110 form as a coplanar waveguide (CPW) transmission line on the top side of the chip 100. Furthermore, as shown in FIG. 8, the signal metal sheet 106, the ground metal sheet 108, the ground metal sheet 110 and the ground lead 104 form a coplanar waveguide with lower ground plane structure (a.k.a., the CPWG structure). The property and characteristics of the CPW structure and the CPWG structure are known by one skilled in the art, which is not narrated herein.

Therefore, the signal lead 102, the signal metal sheet 106 and the hot vias HVA may form a signal path SP (shown in FIG. 5) for delivering the RF signal. In other words, the RF signal may be received at the signal lead 102 (under the backside of the RF device 10 and close to the third edge L3) from the external circuit, delivered through the hot via HAV and the signal metal sheet 106 (on the top side of the chip 100), and transmitted to the top side of the RF device 10. Preferably, an impedance of the signal metal sheet 106 may be designed as 50 ohms.

Notably, the signal metal sheet 106, the ground metal sheet 108 and the ground metal sheet 110 crossing over the gap G2 form as a coplanar waveguide (CPW) transmission line, which means that the signal metal sheet 106, the ground metal sheet 108 and the ground metal sheet 110 form a GSG structure. In order to have better RF performance, an overall area of the ground metal sheet 108 and the ground metal sheet 110 should be as large as possible. In addition, the ground metal sheet 108 and the ground metal sheet 110 are disposed along edges of the signal metal sheet 106 and separated from the edges of the signal metal sheet 106 by the gap G3, so as to form the CPW structure to maintain good RF characteristic across the gap G2 to the top side of the chip 100. According to the transition structure, the RF signal from the backside of the chip 100 would be transferred to the top side of the chip 100. The gap G3 may be smaller/narrower than 70 μm. In an embodiment, the gap G3 may be between 20 μm and 70 μm.

Figure 6:
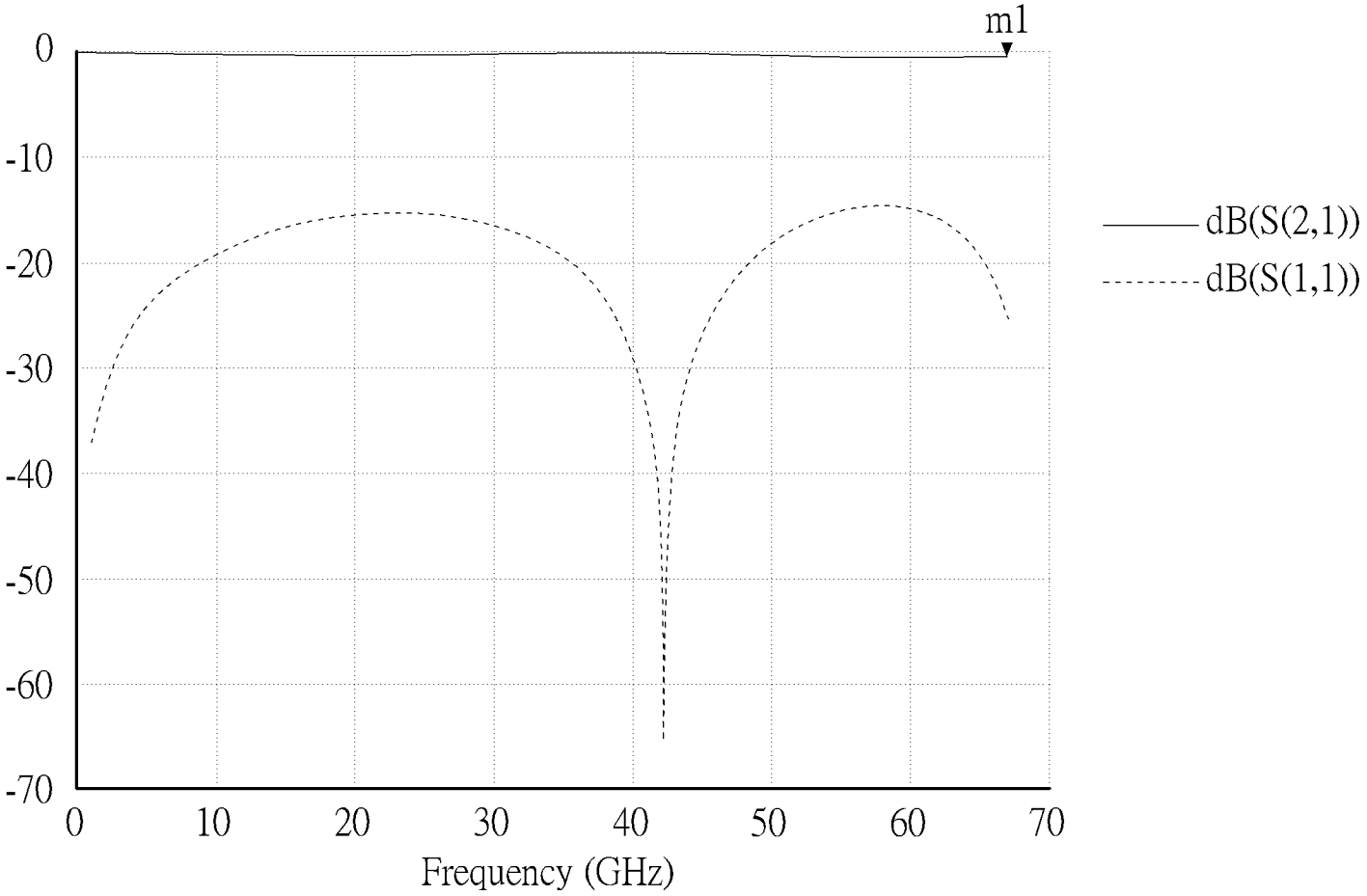
FIG. 6 illustrates a schematic diagram of a transmission coefficient and a reflection coefficient of the RF device of FIG. 1.

The RF performance of the RF device 10 may be referred to FIG. 6, which is a schematic diagram of a transmission coefficient and a reflection coefficient of the RF device 10. In in FIG. 6, a solid line represents the transmission coefficient of the RF device 10, and a dashed line represents the reflection coefficient of the RF device 10. As can be seen from FIG. 6, the transmission coefficient (representing an insertion loss) is merely −0.6 dB when an operating frequency of the RF device 10 is as high as 67 GHz, and the reflection coefficient is less than −15 dB when the operating frequency is less than 67 GHz.

As can be seen, the present invention utilizes the sufficiently large gaps G1 and G2 formed between the signal lead 102 and the ground lead 104 on the backside of the chip and form a GSG structure to external substrate, so as to be easily assembled with an external circuit and prevent the short circuit problem. Meanwhile, the present invention utilizes the signal metal sheet 106, the ground metal sheet 108 and the ground metal sheet 110 to form the CPW structure on the top side of the chip 100, so as to maintain good RF performance and help the RF signal to be delivered across the gap G2 to the a main circuit of the chip 100. Compared to the prior art, the present invention has advantages of being easily assembled and achieving good RF performance.

Figure 9A:
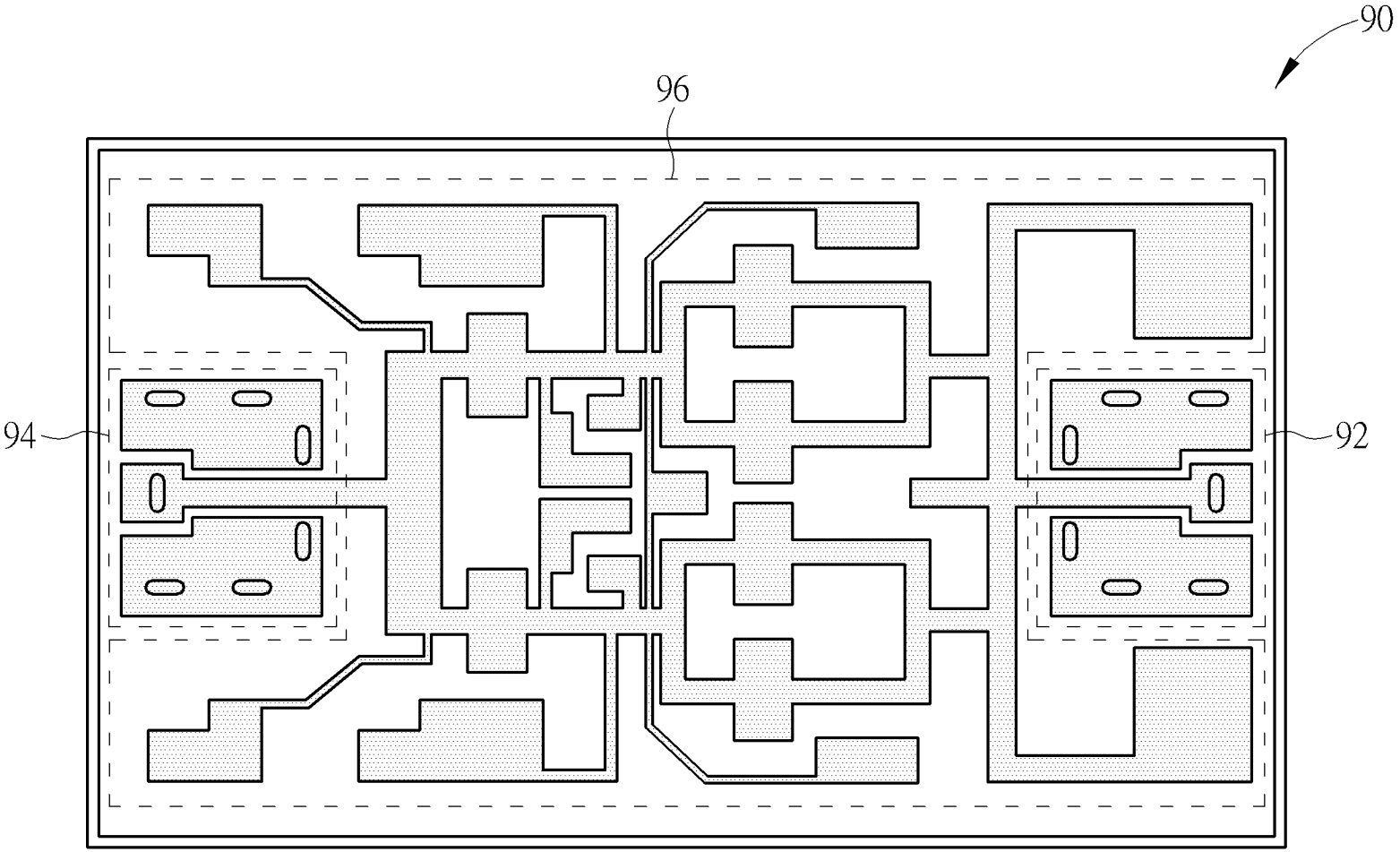
FIG. 9A is a schematic diagram of a top view an RF device according to an embodiment of the present invention.
Figure 9B:
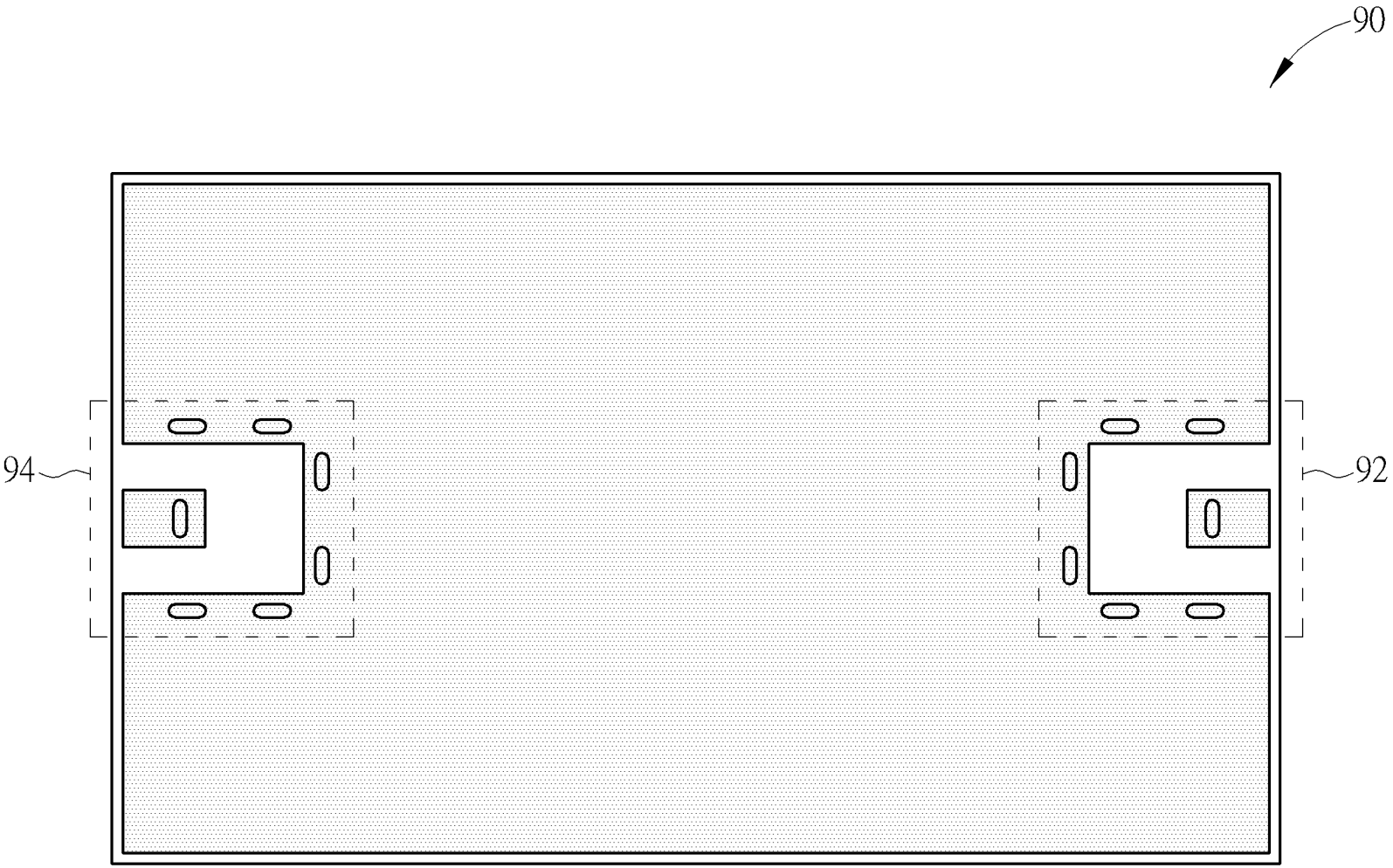
FIG. 9B is a schematic diagram of a bottom view of the RF device of FIG. 9A.

The transition structure formed by the signal lead, the signal metal sheet, the ground metal sheet, the ground metal sheet, the ground lead and the hot via HVA may be applied in a monolithic microwave integrated circuit (MMIC). For example, referring to FIG. 9A and FIG. 9B, which are schematic diagrams of a top view and a bottom view of an RF device 90 according to an embodiment of the present invention. The RF device 90 is an MMIC, which comprises an internal circuit 96 and transition structures 92 and 94. Through the transition structures 92 and 94, the RF signals may be delivered through transition structures 92 and 94 to the internal circuit 96 on a top side of the RF device 90. Notably, there is no bonding wire and package lead in the MMIC 90, and thus, the RF performance of the RF device 90 is further improved, compared to the prior art.

Notably, the embodiments stated in the above are utilized for illustrating the concept of the present invention. Those skilled in the art may make modifications and alternations accordingly, and not limited herein. For example, shapes of the signal lead 102, the ground lead 104, the metal segments

1060 and 1062 are not limited to rectangles. The signal lead 102, the ground lead 104, the metal segments 1060 and 1062 may be other kinds of geometric shape. As long as the signal metal sheet 106, the ground metal sheet 108 and the ground metal sheet 110 form the GSG structure on the top side of the chip 100, requirements of the present invention are satisfied.

In summary, the present invention keeps the gap between the ground lead and the signal lead large enough, so as to be easily assembled with the external circuit. In addition, the present invention utilizes the metal sheets on the top side of the chip to form CPW transmission line and provide the signal path, so as to maintain god RF performance. Compared to the prior art, the present invention is easily assembled and achieves better RF performance.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A radio frequency (RF) device, comprising:

a chip, comprising a plurality of vias and at least a hot via;

a signal lead, disposed by an edge of the RF device and under a back side of the chip;

a ground lead, disposed under the back side of the chip, and substantially surrounding the signal lead, wherein a first gap is formed between the signal lead and the ground lead along with a first direction, and a second gap is formed between the signal lead and the ground lead along with a second direction;

a signal metal sheet, disposed on a top side of the chip, and comprising a first metal segment and a second metal segment, wherein the first metal segment is disposed by the edge of the RF device, above the signal lead and coupled to the signal lead through the at least a hot via, the second metal segment crosses over the second gap formed between the signal lead and the ground lead;

a first ground metal sheet, disposed by a first side of the second metal segment on the top side of the chip; and a second ground metal sheet, disposed by a second side of the second metal segment on the top side of the chip;

wherein the first ground metal sheet and the second ground metal sheet are coupled to the ground lead through the plurality of vias, and the first ground metal sheet and the second ground metal sheet substantially surround the signal metal sheet;

wherein the second metal segment, the first ground metal sheet, the second ground metal sheet and the ground lead form a coplanar waveguide with lower ground plane structure (CPWG);

wherein the first gap or the second gap is larger than 200 micrometer (μm);

wherein a third gap is formed between the signal metal sheet and the first ground metal sheet, the third gap is always smaller than the first gap and smaller than the second gap, and the third gap is smaller than 70 μm;

wherein a first orthogonal projection result of the first ground metal sheet onto the back side comprises a first empty region and a first ground region, a second orthogonal projection result of the second ground metal sheet onto the back side comprises a second empty region and a second ground region, such that the ground lead overlaps with the first ground region and the second ground region, but does not overlap with the first empty region and the second empty region;

wherein a plurality of first vias among the plurality of vias are symmetric to a plurality of second vias among the plurality of vias with respect to the second metal segment, and the plurality of first vias are noncollinear;

wherein the plurality of vias are oval, a major axis of each of a plurality of fifth vias among the plurality of vias are parallel to the first direction, and a major axis of each of a plurality of sixth vias among the plurality of vias are parallel to the second direction.

2. The RF device of claim 1, wherein the ground lead comprises a first ground edge by the first gap and a second ground edge by the second gap, the first ground edge is perpendicular to the first direction, the second ground edge is perpendicular to the second direction, a plurality of third vias among the plurality of vias overlaps with a first area viewed from the first ground edge along the first direction, and a plurality of fourth vias among the plurality of vias overlaps with a second area viewed from the second ground edge along the second direction, the first area and the second area are nonoverlapping, the second area is rectangular, and the plurality of vias surrounds the at least a hot via.

3. The RF device of claim 2, wherein the plurality of fourth vias among the plurality of vias is not beyond an extension line extended from the first ground edge along the second direction.

4. The RF device of claim 1, wherein the first gap or the second gap is 300 μm.

5. The RF device of claim 1, wherein the third gap is between 20 μm and 70 μm.

6. The RF device of claim 1, wherein the signal lead and the ground lead form a ground-signal-ground (GSG) structure on the back side of the chip.

7. The RF device of claim 1, wherein an impedance of the signal metal sheet is 50 ohms.

8. The RF device of claim 1, wherein a first width of the first metal segment is larger than a second width of the second metal segment, the first metal segment is rectangular, the first ground metal sheet comprises two right-angle corners, the second ground metal sheet comprises two right-angle corners, such that the first ground metal sheet and the second ground metal sheet surround the signal metal sheet.

9. The RF device of claim 1, wherein the first metal segment is completely overlapped with the signal lead.

* * * * *